US010538872B2

(12) United States Patent
Deshpande

(10) Patent No.: US 10,538,872 B2
(45) Date of Patent: Jan. 21, 2020

(54) BRACKET FOR A WASHING MACHINE APPLIANCE

(71) Applicant: Haier US Appliance Solutions, Inc., Wilmington, DE (US)

(72) Inventor: Rajendra Dattatraya Deshpande, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 527 days.

(21) Appl. No.: 15/356,703

(22) Filed: Nov. 21, 2016

(65) Prior Publication Data

US 2018/0142401 A1 May 24, 2018

(51) Int. Cl.
*D06F 37/20* (2006.01)
*D06F 39/12* (2006.01)

(52) U.S. Cl.
CPC ..... *D06F 37/20* (2013.01); *D06F 39/125* (2013.01)

(58) Field of Classification Search
CPC ..... D06F 37/20
See application file for complete search history.

(56) References Cited

U.S. PATENT DOCUMENTS 3,729,960 A * 5/1973 Skinner, II ..... D06F 37/24 68/23.3

FOREIGN PATENT DOCUMENTS

| | | | |
|---|---|---|---|
| JP | H07323190 | A | 12/1995 |
| KR | 269380 | B1 | 10/2000 |
| KR | 792717 | B1 | 1/2008 |

* cited by examiner

*Primary Examiner* — Michael E Barr
*Assistant Examiner* — Jason P Riggleman
(74) *Attorney, Agent, or Firm* — Dority & Manning, P.A.

(57) ABSTRACT

A bracket for mounting a sub-washer unit of a washing machine appliance includes a first plate spaced apart from a second plate along a vertical direction. The first and second plates may be formed from a continuous piece of material. The second plate is fixable to an apron of the washing machine such that the first plate is cantilevered with respect to the second plate when the second plate is fixed to the apron. A related washing machine appliance is also provided.

10 Claims, 6 Drawing Sheets

BRACKET FOR A WASHING MACHINE APPLIANCE

FIELD OF THE INVENTION

The present subject matter relates generally to washing machine appliances and, more particularly, to brackets that connect sub-washer units to an apron.

BACKGROUND OF THE INVENTION

Washing machine appliances typically include an apron and a sub-washer unit. A wash basket of the sub-wash unit has a wash chamber for receipt of clothing articles. Washing machine appliances utilize wash and rinse fluids to clean clothing articles within the wash chamber. The wash basket rotates with respect to the apron in order to move the clothing articles within the wash basket. The sub-washer unit is preferably mounted within the apron such that the sub-washer unit does not collide with other parts of the washing machine appliance, e.g., when the wash basket is rotating.

In certain known washing machine appliances, the sub-washer unit is attached to the apron by inserting mounts of the sub-washer unit into simple, fixed corner brackets mounted to the apron. The fixed corner brackets are generally a flat piece of sheet metal that is welded or otherwise fixed to the apron. Use of such fixed corner brackets can cause the apron to flex during operation of the washing machine as force is transferred from the sub-washer unit to the apron, and in extreme cases, can cause the washing machine to move or "walk." Vibration and walking of the washing machine negatively impacts consumer perception as well as reliability, due to high wear and tear.

Accordingly, a washing machine appliance with features for limiting vibration transfer and relative movement between a sub-washer unit and an apron would be useful.

BRIEF DESCRIPTION OF THE INVENTION

The present subject matter provides a bracket for a washing machine. The bracket includes a first plate spaced apart from a second plate along a vertical direction. The first and second plates may be formed from a continuous piece of material. The second plate is fixable to an apron of the washing machine such that the first plate is cantilevered with respect to the second plate when the second plate is fixed to the apron. A related washing machine appliance is also provided. Additional aspects and advantages of the invention will be set forth in part in the following description, or may be apparent from the description, or may be learned through practice of the invention.

In a first exemplary embodiment, a bracket for a washing machine is provided. The washing machine defines a lateral direction, a transverse direction, and a vertical direction. The lateral, transverse, and vertical directions are mutually orthogonal. The bracket includes a first plate spaced apart from a second plate along the vertical direction. The first plate and the second plate are formed from a continuous piece of material. The second plate is fixable to the washing machine appliance such that the first plate is cantilevered with respect to the second plate when the second plate is fixed. The second plate is generally triangularly shaped in a plane that is perpendicular to the vertical direction. The first plate includes a cavity. The cavity is shaped to receive a mounting unit of a sub-washer unit.

In a second exemplary embodiment, a washing machine appliance is provided. The appliance includes an apron defining a lateral direction, a transverse direction, and a vertical direction. The lateral, transverse, and vertical directions are mutually orthogonal. A sub-washer unit is positioned within the apron. The sub-washer unit includes a wash basket configured for the receipt of articles during a washing process and for rotation about a vertical axis. A top panel on the apron defines an opening for accessing the wash basket. A bracket is configured for receipt of a mount for the sub-washer unit. The bracket is positioned below the top panel along the vertical direction. The bracket includes a first plate. A second plate is mounted to the first plate such that the second plate is spaced apart from the first plate along the vertical direction. The second plate is fixed to the apron such that the first plate is cantilevered with respect to the second plate. The mount is positioned on the first plate such that the mount is displaceable along the vertical direction with respect to the second plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
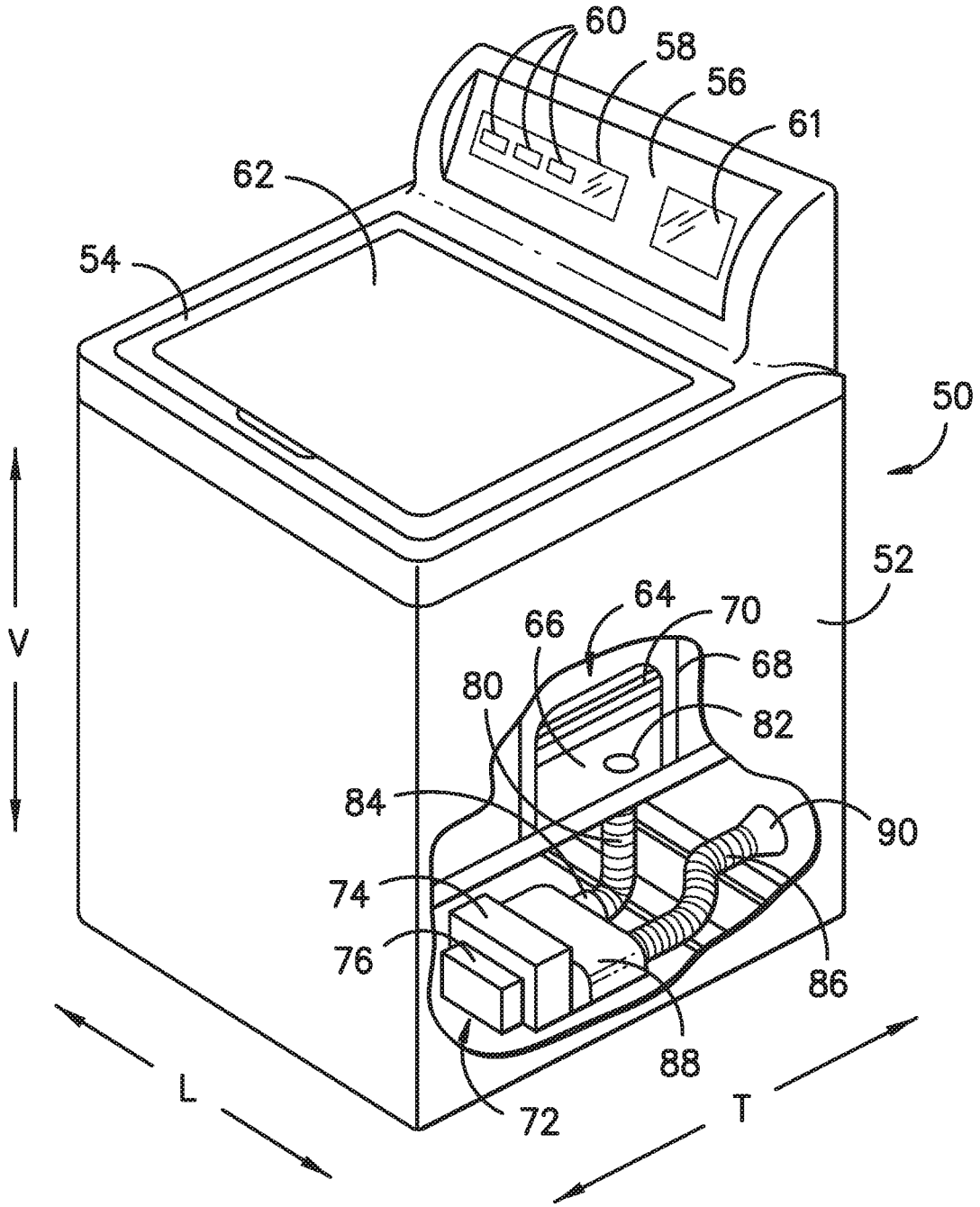
FIG. 1 provides a perspective view of a washing machine appliance according an exemplary embodiment of the present subject matter.

Reference will now be made in detail to embodiments of the invention, one or more examples of which are illustrated in the drawings. Each example is provided by way of explanation of the invention, not limitation of the invention. In fact, it will be made apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 defines a vertical direction V, a lateral direction L and a transverse direction T. The vertical direction V, lateral direction L and transverse direction T are mutually perpendicular and form an orthogonal direction system.

Washing machine appliance 50 includes a cabinet or apron 52 and a top panel or cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within apron 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

A sub-washer unit 65 is mounted within apron 52. Sub-washer unit 65 includes tub 64 and a basket 70. Tub 64 includes a bottom wall 66 and a sidewall 68, and basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
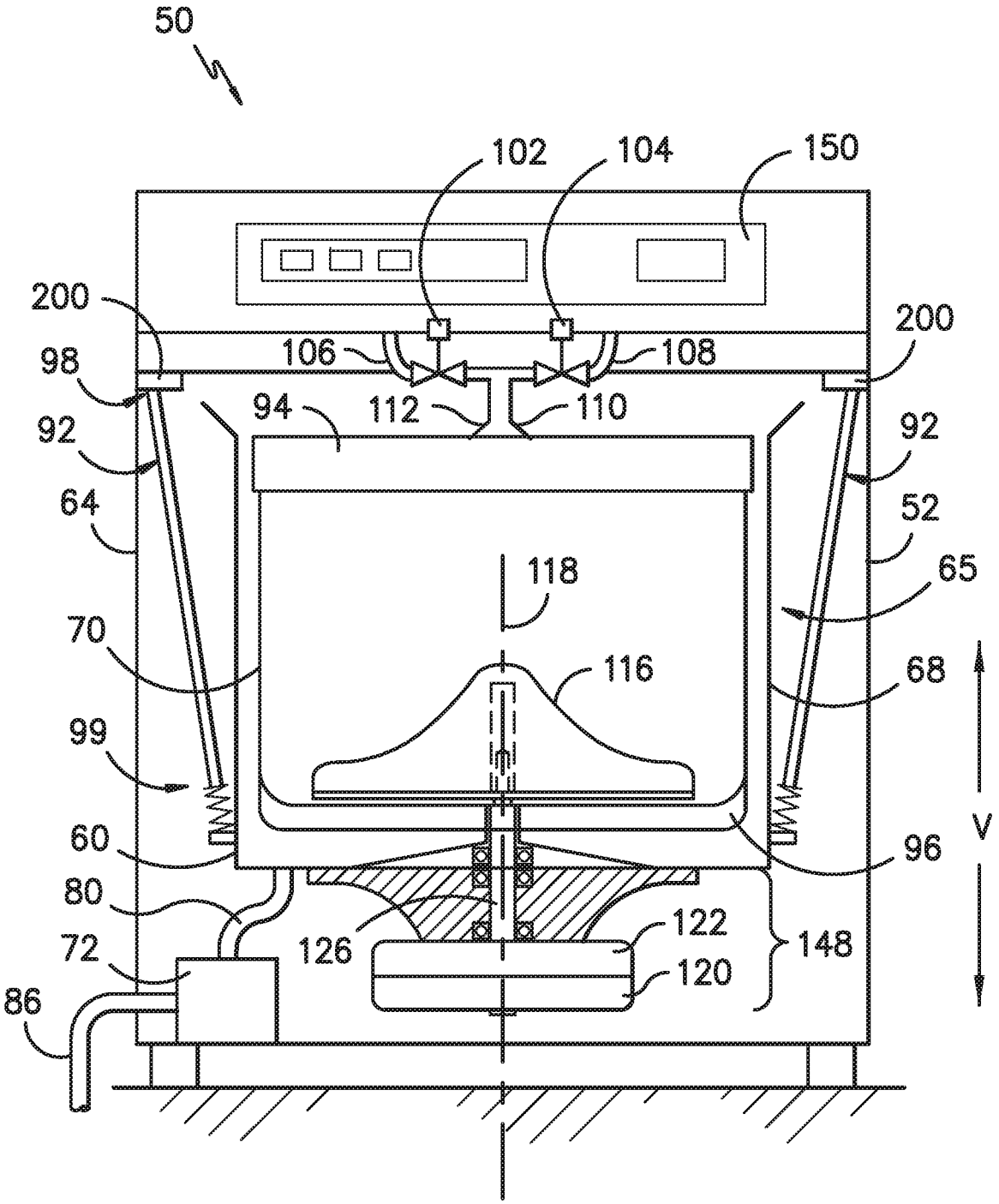
FIG. 2 provides a perspective view of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148 and may be a component of sub-washer unit 65.

Sub-washer unit 65 further includes a vibration dampening suspension system or mount 92 for supporting sub-washer unit 65 within apron 52. One end of mount 92 may be connected to sub-washer unit 65 while an opposite end of mount 92 is receivable within and/or coupled to at least one bracket 200. Thus, mount 92 may extend between sub-washer unit 65 and bracket 200 in order to suspend sub-washer unit 65 within apron 52.

Mount 92 can include a plurality of damping elements, such as piston-cylinder damping elements, coupled to the wash tub 64. The dampening suspension system 92 can include other elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Operation of washing machine appliance 50 is controlled by a controller (not shown) which is operatively coupled to the user interface input located on washing machine backsplash 56 (shown in FIG. 1) for user manipulation to select washing machine cycles and features. In response to user manipulation of the user interface input, the controller operates the various components of washing machine appliance 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed and portions of the cycle may be repeated, including the agitation phase, depending on the particulars of the wash cycle selected by a user.

During a spin cycle, wash basket 70 is rotated at relatively high speeds. Such high speed rotation may cause vibration and/or relative movement of the sub-washer unit 65 with respect to apron 52. As such, a bracket 200 for supporting sub-washer unit 65 within apron 52 may be sufficiently robust so as to provide a sturdy and reliable connection between sub-washer unit 65 and apron 52, Bracket 200 also includes features for reducing vibration and/or relative movement transferred between apron 52 from sub-washer unit 65, as discussed in greater detail below.

Figure 3:
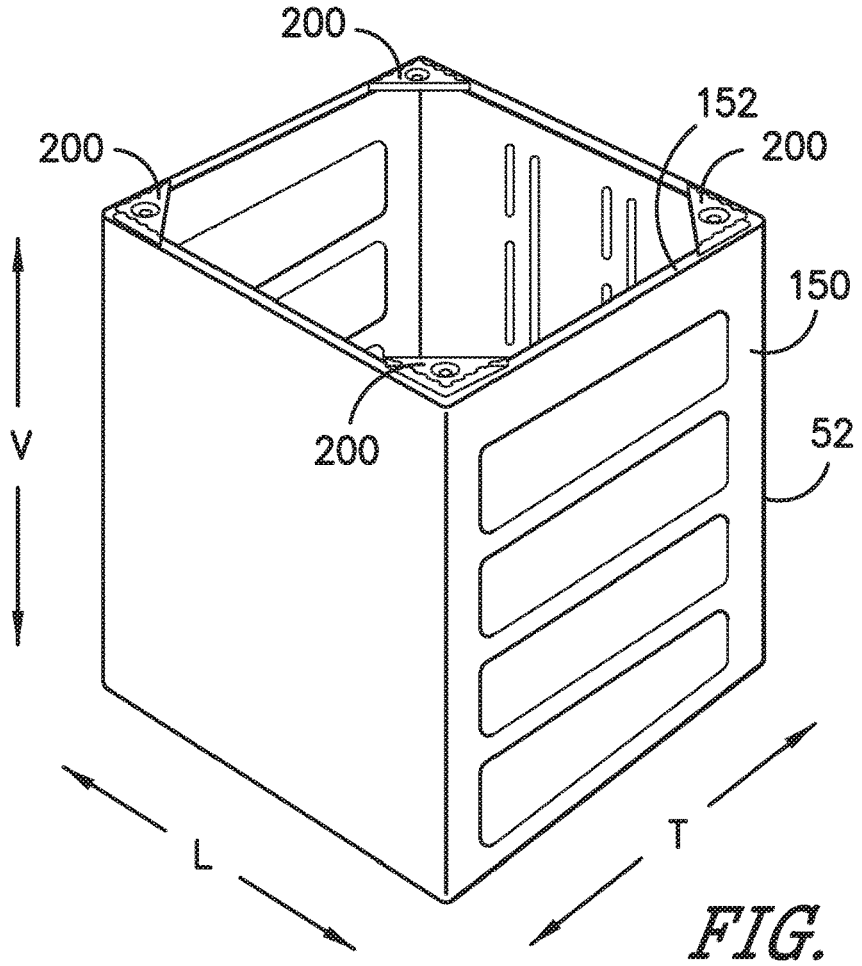
FIG. 3 provides a top, perspective view of certain components of the exemplary washing machine appliance of FIG. 2, including four brackets mounted to an apron.

Referring now to FIGS. 3 through 7, an exemplary embodiment of bracket 200 is described in greater detail below. It will be understood that, while described in the context of washing machine appliance 50, bracket 200 may be used in or with any other suitable washing machine appliance in alternative exemplary embodiments. As shown in FIG. 3, a respective bracket 200 may be connected or mounted to each corner of apron 52. Thus, washing machine appliance 50 may include four brackets 200. Bracket 200 may be disposed below cover top panel 54 of apron 52 along the vertical direction V, e.g., such that brackets 200 are not visible to a user of washing machine appliance 50. However, it is to be understood that a similar arrangement can also be provided at other locations, e.g. a mirrored version along a bottom edge of apron 52, as discussed in greater detail below.

Figure 4:
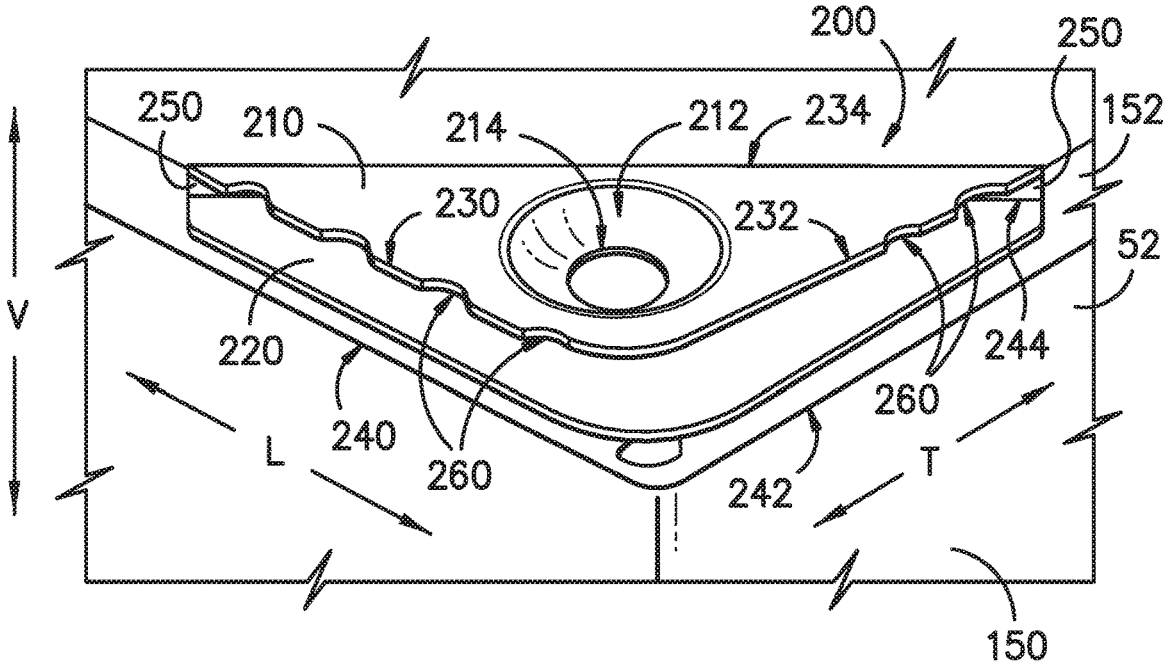
FIG. 4 provides a perspective view of a bracket according to an exemplary embodiment of the present subject matter.

As may be seen in FIG. 4, bracket 200 includes a first plate 210 spaced apart from a second plate 220 along the vertical direction V. As an example, first plate 210 and second plate 220 may be formed from a continuous or seamless piece of material, such as sheet metal. The continuous piece of material may be bent or otherwise plastically deformed to form and position first and second plates 210, 220 as shown in FIGS. 4 through 7. Thus, bracket 200 may have a web or bend 250 between the first and second plates 210, 220. In certain exemplary embodiments, the bracket 200 may be manufactured from a sheet of spring steel or low alloy high strength that can resist compression set. In alternative exemplary embodiments, first and second plates 210, 220 may be separate pieces of material that are mounted or fixed to each other. For example, a discrete web may extend between first and second plates 210, 220, and first and second plates 210, 220 may be welded to the web to form bracket 200.

First plate 210 may be spaced apart from second plate 220 along the vertical direction V by any suitable amount. For example, first plate 210 may be spaced apart from second plate 220 along the vertical direction V by no less than a quarter of an inch and no more than two inches in certain exemplary embodiments. A gap or spacing along the vertical direction V between first and second plates 210, 220 may be selected to provided sufficient deflection along the vertical direction V for first plate 210 while avoiding impacting second plate 220. First plate 210 may be oriented parallel with second plate 220, e.g., when sub-washer unit 65 is unloaded and/or when washing machine appliance 50 is not operating.

At least one of the first and second plates 210, 220 may have a triangular shape, e.g., such that the bracket 200 may be mounted in a corner of the apron 52. In an exemplary embodiment, the second plate 220 has a generally triangular shape. Thus, while all edges of second plate 220 are not rectilinear, second plate 220 has three primary edges that are positioned and oriented to give second plate 220 a triangular appearance. When first and second plates 210, 220 have the triangular shape, each of first plate 210 and second plate 220 may include a first edge 230, 240 extending along the lateral direction L, a second edge 232, 242 extending along the transverse direction T, and a third edge 234, 244 extending in a direction not parallel to the lateral and transverse edges L, T. Third edge 234 of first plate 210 connects to third edge 244 of second plate 220 proximate bend 250 of bracket 200.

Figure 6:
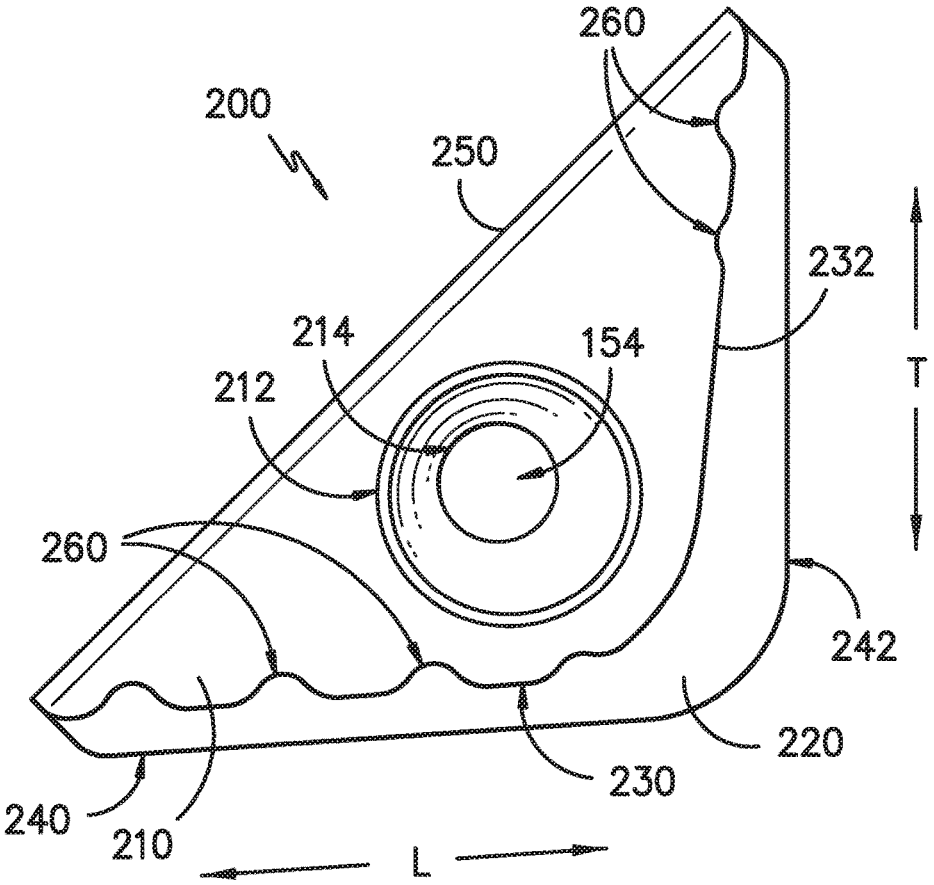
FIG. 6 provides a top-down view of the exemplary bracket of FIG. 4.

Second plate 220 is fixable to the apron 52 using any suitable method or mechanism, e.g. TOX® sheet metal fastening, screws, rivets, welding, adhesive, etc. In an exemplary embodiment, second plate 220 is fixable to a top flange 152 of a side panel 150 of apron 52 at or proximate first edge 240 and second edge 242 of second plate 220. First plate 210 is cantilevered with respect to the second plate 220 when second plate 220 is fixed to apron 52. Thus, first plate 210 may deflect along the vertical direction V, e.g., due to elastic deformation of bracket 200 at bend 250, during operation of washing machine appliance 50, in order to reduce or limit vibration transfer between apron 52 and sub-washer unit 65. As shown in FIG. 6, first plate 210 is configured with a plurality of cutouts 260 along first edge 230 and second edge 232 of first plate 210. The cutouts 260 are shaped for receiving at least part of a mounting tool for fixing second plate 220 to apron 52. Thus, the second plate 220 may be positioned directly below the plurality of cutouts 260 along the vertical direction V in order to allow a tool to be positioned within cutouts 260 such that the tool may extend through or by first plate 210 to second plate 220.

Figure 5:
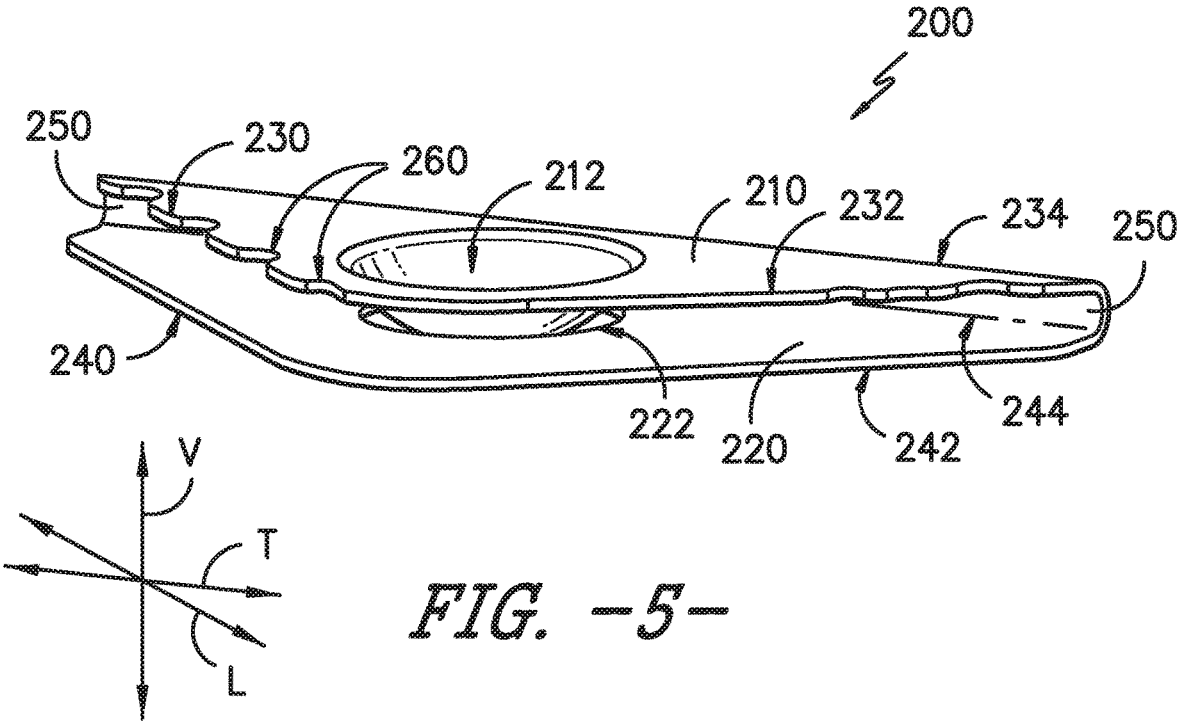
FIG. 5 provides a perspective view of the exemplary bracket of FIG. 4.

First plate 210 may define a cavity 212, e.g., positioned at or proximate a centroid 154 of first plate 210. As an example, cavity 212 may be embossed or otherwise suitable formed by plastically deforming first plate 210, e.g., prior to being bent to position first and second plates 210, 220 shown in FIGS. 4 through 7. Cavity 212 is shaped to receive mount 92 of sub-washer unit 65. Thus, a shape of cavity 212 may be complementary to a shape of mount 92 of sub-washer unit 65. In particular, cavity 212 may have a semi-spherical shape as shown in FIGS. 4 through 6 such that mount 92 may rotate or pivot within cavity 212 when a first end portion 98 of mount 92 has a spherical or semi-spherical shape. An outer surface of mount 92 may be positioned at and slide on bracket 200 at cavity 212 during operation of washing machine appliance 50, e.g., in order to limit or reduce vibration transfer between apron 52 and sub-washer unit 65.

Second plate 220 defines an opening 222. Opening 222 of second plate 220 may be positioned at or proximate a centroid of second plate 220 (not shown but positioned coaxially along the vertical direction V with centroid 154 of first plate 210 in FIG. 6). As may be appreciated from FIG. 5, cavity 212 is positioned at or proximate opening 222 of second plate 220. Cavity 212 may also define an opening 214. Opening 214 of cavity 212 may be positioned concentrically within cavity 212 of first plate 210 with respect to opening 222 of second plate 220. Each of the cavity 212, opening 214 of cavity 212, and opening 222 of second plate 220 may have a circular shape or cross-section, e.g., in a plane perpendicular to the vertical direction V.

Figure 7:
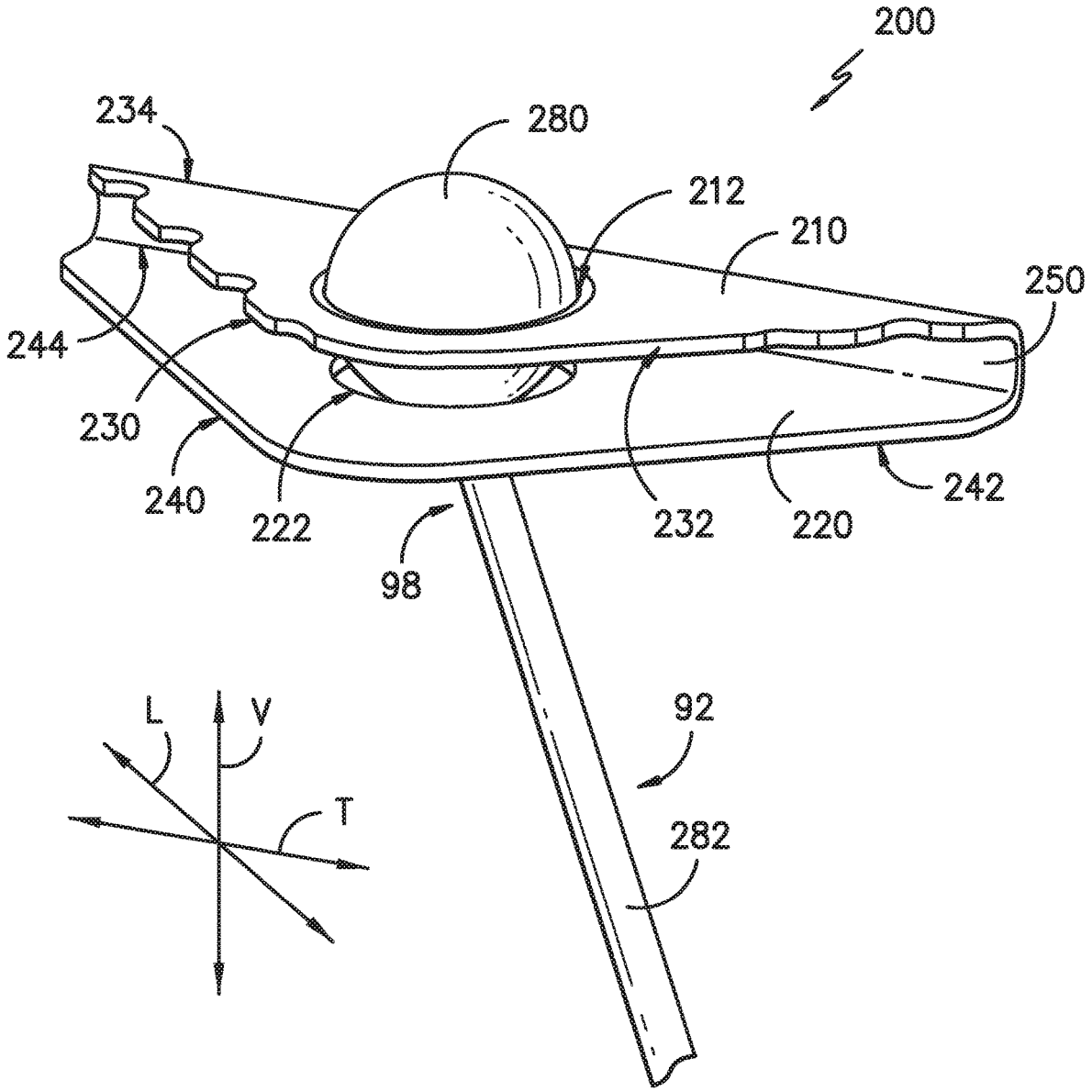
FIG. 7 provides a perspective view of the exemplary bracket of FIG. 4 with an installed sub-washer unit mount.

As may be seen in FIG. 7, mount 92 of sub-washer unit 65 is positioned at the cavity 212 of the first plate 210 and extends through the opening 214 of cavity 212 and the opening 222 of the second plate 220 to sub-washer unit 65, e.g., tub 64 of sub-washer unit 65. The mount 92 may be of any suitable configuration for attaching the sub-washer unit 65 to the apron 52 of the washing machine appliance 50 via bracket 200. In an exemplary embodiment, the mount 92 is configured to further reduce vibration transferred from the sub-washer unit 65 to the apron 52, such as a rod and spring assembly 99 with at least one ball 280 positioned in cavity 212 to form a ball joint. A shaft 282 may extend from ball 280 through opening 214 of cavity 212 and opening 222 of second plate 220 to sub-washer unit 65. As another example, mount 92 of sub-washer unit 65 may include damping or suspension features disclosed in U.S. Patent Application Publication No. 2015/0337478 of Paul O. Davis or U.S. Pat. No. 5,884,891 of Larry L. Hawkins, both of which are incorporated by reference herein in their entirety.

Figure 8:
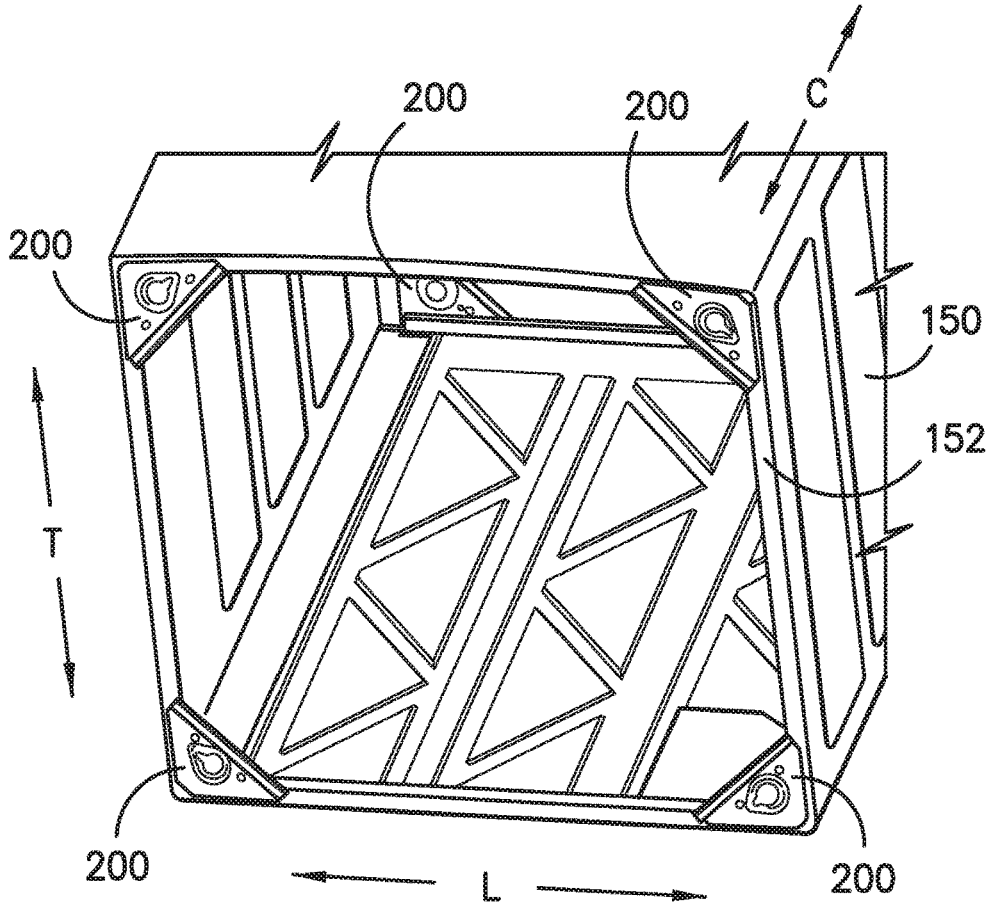
FIG. 8 provides a bottom, partial perspective view of certain components of the exemplary washing machine appliance of FIG. 2, including four bottom brackets mounted to the apron.

FIG. 8 provides a bottom, partial perspective view of apron 52. As may be seen in FIG. 8, washing machine appliance 50 may also include four brackets 200 at a bottom portion of apron 52, e.g., in addition to the four brackets 200 at the top portion of apron 52. Brackets 200 may be disposed within apron 52, e.g., such that brackets 200 are not visible to a user of washing machine appliance 50. It will be understood that in certain exemplary embodiments, washing machine appliance 50 may include only brackets 200 at the top portion of apron 52 (in the manner shown in FIG. 3), only brackets 200 at the bottom portion of apron 52 (in the manner shown in FIG. 8) or brackets 200 at both the top and bottom portions of apron 52.

Brackets 200 at the bottom portion of apron 52 may be constructed in the same or similar manner as discussed above, e.g., such that brackets 200 at the bottom portion of apron 52 are compliant along the vertical direction V when mounted to apron 52. However, rather than assisting with mounting sub-washer unit 65 to apron 52, brackets 200 at the bottom portion of apron 52 assist with mounting feet for supporting (and leveling) washing machine appliance 50.

Figure 9:
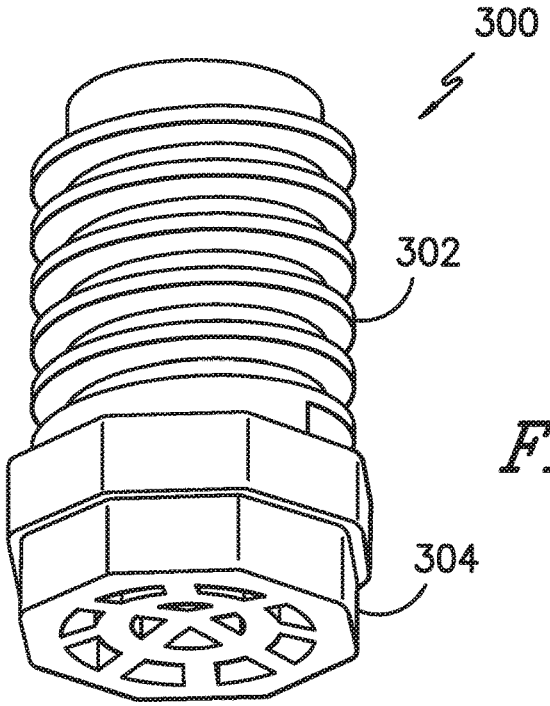
FIG. 9 provides a perspective view of a foot as may be mounted to one of the four bottom brackets of FIG. 8.

FIG. 9 provides a perspective view of a foot 300 as may be mounted to one of brackets 200 at the bottom portion of apron 52. As shown in FIG. 9, foot 300 includes a thread 302 and pad 304. Thus, foot 300 may be mounted to first plate 210 of bracket 200 by rotating foot 300 such that thread 302 meshes with a corresponding thread on first plate 210, e.g., at opening 214 of cavity 212. In alternative exemplary embodiments, brackets 200 at the bottom portion of apron 52 may not include cavity 212 such that first plate 210 is substantially planar or flat, and foot 300 may be threaded to first plate 210 at an opening in first plate 210. By mounting foot 300 to first plate 210, brackets 200 may assist with reducing or limiting vibration transfer between apron 52 and foot 300, e.g., and thereby limit "walking" or noise during operation of washing machine appliance 50.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, the appliance comprising:

an apron defining a lateral direction, a transverse direction, and a vertical direction, the lateral, transverse, and vertical directions being mutually orthogonal;

a sub-washer unit positioned within the apron, the sub-washer unit comprising a wash basket configured for the receipt of articles during a washing process and for rotation about a vertical axis;

a top panel on the apron defining an opening for accessing the wash basket; and a bracket configured for receipt of a mount for the sub-washer unit, the bracket positioned below the top panel along the vertical direction, the bracket comprising:

a first plate; and a second plate directly connected to the first plate such that the second plate is spaced apart from the first plate along the vertical direction, the second plate fixed to the apron such that the first plate is cantilevered with respect to the second plate, the mount positioned on the first plate such that the mount is displaceable along the vertical direction with respect to the second plate.

2. The washing machine appliance of claim 1, wherein the first plate of the bracket defines a cavity, the cavity shaped complementary to the mount of the sub-washer unit.

3. The washing machine appliance of claim 2, wherein the second plate of the bracket defines an opening.

4. The washing machine appliance of claim 3, wherein the cavity is positioned in the opening of the second plate.

5. The washing machine appliance of claim 2, wherein the cavity of the bracket is positioned at a centroid of the first plate, and the opening of the second plate of the bracket is positioned at a centroid of the second plate.

6. The washing machine appliance of claim 2, wherein the cavity of the bracket comprises an opening, the opening of the cavity positioned concentrically with the opening in the second plate of the bracket.

7. The washing machine appliance of claim 1, wherein each of the first and second plates comprises a first edge extending along the lateral direction, a second edge extending along the transverse direction, and a third edge extending in a direction that is not parallel to the lateral and transverse directions, the second plate fixed to the apron along the first and second edges.

8. The washing machine appliance of claim 7, wherein the first plate and second plate are formed from a continuous piece of material, the third edge of the first plate connecting to the third edge of the second plate proximate a bend of the continuous piece of material.

9. The washing machine appliance of claim 7, wherein the first plate of the bracket has a plurality of cutouts along the first edge and the second edge, the second plate being positioned directly under the plurality of cutouts.

10. The washing machine appliance of claim 1, further comprising an additional bracket and a foot, the additional bracket having a first plate and a second plate, the second plate of the additional bracket mounted to the first plate of the additional bracket such that the second plate of the additional bracket is spaced apart from the first plate of the additional bracket along the vertical direction, the second plate of the additional bracket fixed to the apron at a bottom portion of the apron such that the first plate of the additional bracket is cantilevered with respect to the second plate of the additional bracket, the foot threaded to the first plate of the additional bracket.

* * * * *